US009646749B2

(12) United States Patent
Suehiro et al.

(10) Patent No.: US 9,646,749 B2
(45) Date of Patent: May 9, 2017

(54) GRAIN-ORIENTED ELECTRICAL STEEL SHEET

(71) Applicant: JFE STEEL CORPORATION, Tokyo (JP)

(72) Inventors: Ryuichi Suehiro, Tokyo (JP); Hiroi Yamaguchi, Tokyo (JP); Seiji Okabe, Tokyo (JP); Hirotaka Inoue, Tokyo (JP); Shigehiro Takajo, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 73 days.

(21) Appl. No.: 14/368,806

(22) PCT Filed: Dec. 27, 2012

(86) PCT No.: PCT/JP2012/008366
§ 371 (c)(1),
(2) Date: Jun. 26, 2014

(87) PCT Pub. No.: WO2013/099258
PCT Pub. Date: Jul. 4, 2013

(65) Prior Publication Data

US 2014/0352849 A1 Dec. 4, 2014

(30) Foreign Application Priority Data

Dec. 27, 2011 (JP) ..... 2011-286897

(51) Int. Cl.
*H01F 1/16* (2006.01)
*C21D 8/12* (2006.01)
(Continued)

(52) U.S. Cl.
CPC ..... *H01F 1/16* (2013.01); *C21D 1/38* (2013.01); *C21D 8/12* (2013.01); *C21D 8/1277* (2013.01);
(Continued)

(58) Field of Classification Search
CPC ..... H01F 1/16; C21D 8/12; C21D 2201/05
(Continued)

(56) References Cited

U.S. PATENT DOCUMENTS 4,293,350 A 10/1981 Ichiyama et al.
5,244,511 A 9/1993 Komatsubara et al.
(Continued)

FOREIGN PATENT DOCUMENTS

CN 1114687 A 1/1996
JP 57-2252 1/1982
(Continued)

OTHER PUBLICATIONS

Chinese Office Action dated Jun. 3, 2015; Appln. No. 2012800650850.
(Continued)

*Primary Examiner* — Weiping Zhu
(74) *Attorney, Agent, or Firm* — Young & Thompson

(57) ABSTRACT

The present invention proposes a method that can reduce the noise generated by a transformer core and the like when formed by laminations of a grain-oriented electrical steel sheet in which core loss has been reduced by a magnetic domain refinement process. In this steel sheet, linear distortion extending with an orientation in which an angle formed with a direction perpendicular to the rolling direction of the steel sheet is an angle of 30° or less is periodic in the direction of rolling of the steel sheet, core loss ($W_{17/50}$) is 0.720 W/kg or less, and magnetic flux density ($B_8$) is 1.930 T. The volume of the closure domain arising in the distortion part is 1.00-3.00% of the total magnetic domain volume within the steel sheet.

7 Claims, 1 Drawing Sheet

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/60*** | (2006.01) |
| ***C21D 1/38*** | (2006.01) |

(52) U.S. Cl.
CPC ..... *C21D 8/1294* (2013.01); *C22C 38/00* (2013.01); *C22C 38/001* (2013.01); *C22C 38/02* (2013.01); *C22C 38/04* (2013.01); *C22C 38/06* (2013.01); *C22C 38/60* (2013.01); *C21D 2201/05* (2013.01)

(58) Field of Classification Search
USPC ..... 148/308
See application file for complete search history.

(56) References Cited

U.S. PATENT DOCUMENTS

| | | | |
|---|---|---|---|
| 5,665,455 | A | 9/1997 | Sato |
| 5,690,868 | A | 11/1997 | Strauss et al. |
| 2015/0010762 | A1 | 1/2015 | Yamaguchi |

FOREIGN PATENT DOCUMENTS

| | | | | |
|---|---|---|---|---|
| JP | S59-229419 | A | 12/1984 | |
| JP | S64-68425 | A | 3/1989 | |
| JP | 04-83823 | | 3/1992 | |
| JP | 6-72266 | | 9/1994 | |
| JP | 2000-63950 | A | 2/2000 | |
| JP | 2006-144058 | | 6/2006 | |
| JP | WO 2011158519 | A1 * | 12/2011 | ..... C21D 8/12 |
| JP | 2012-031516 | | 2/2012 | |
| JP | 2012-036442 | | 2/2012 | |
| JP | 2012-057218 | | 3/2012 | |
| JP | WO2013-099160 | A1 | 7/2013 | |
| WO | 2011158519 | | 12/2011 | |

OTHER PUBLICATIONS

Korean Office Action dated May 20, 2015; Appln. No. 10-2014-7018637.

Extended European Search Report (EESR) issued by European Patent Office dated May 7, 2015; Appln. No. 12863175.1.

International Preliminary Report on Patentability dated Jul. 1, 2014; Application No. 2012S01584.

International Search Report PCT/JP2012/008366 dated Mar. 12, 2013.

Masahiro Fujikura et al., "Effect of Laser Irradiation on the Magnetostriction of Grain-Oriented Electrical Steels", Journal of Magnetics Society of Japan, vol. 25, No. 4-2, Apr. 15, 2001, pp. 895 to 898.

Japanese Office Action, dated Nov. 11, 2014, in corresponding Japanese Patent Application No. 2013-551465.

European Patent Office Application No. 12863175.1; dated Feb. 9, 2016.

* cited by examiner

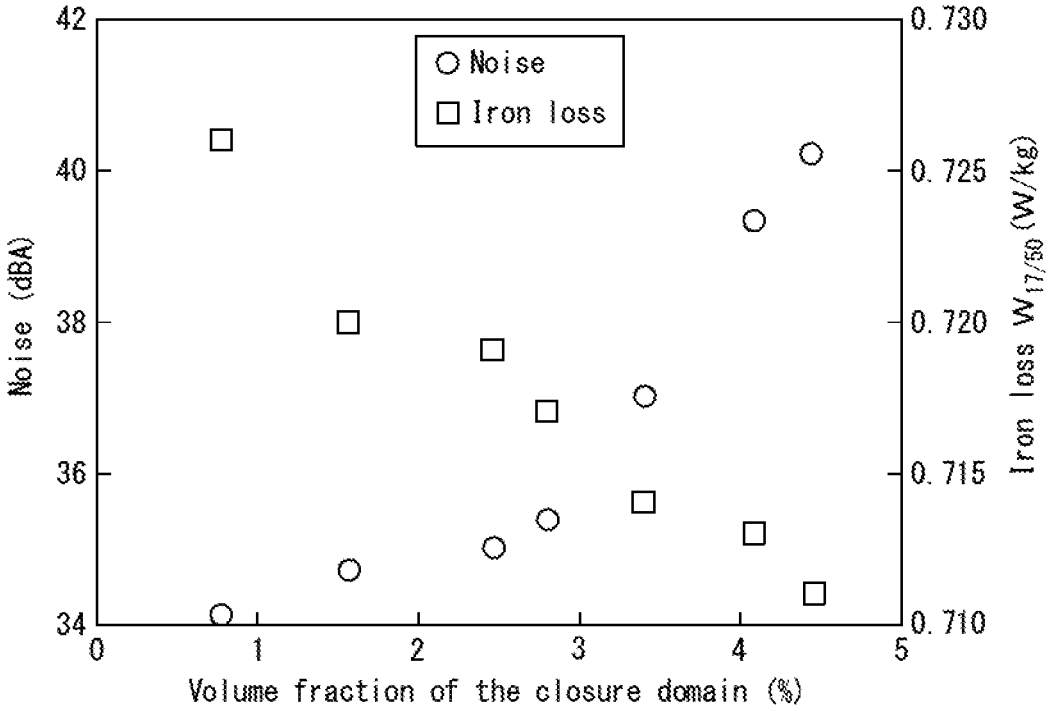
Noise
Iron loss
Noise (dBA)
Iron loss $W_{17/50}$ (W/kg)
Volume fraction of the closure domain (%)
42
40
38
36
34
0.730
0.725
0.720
0.715
0.710
0
1
2
3
4
5

GRAIN-ORIENTED ELECTRICAL STEEL SHEET

TECHNICAL FIELD

The present invention relates to a grain-oriented electrical steel sheet advantageously utilized for an iron core of a transformer or the like.

BACKGROUND ART

A grain-oriented electrical steel sheet is mainly utilized as an iron core of a transformer and is required to exhibit superior magnetization characteristics, in particular low iron loss.

In this regard, it is important to highly accord secondary recrystallized grains of a steel sheet with (110)[001] orientation, i.e. the "Goss orientation", and reduce impurities in a product steel sheet. Furthermore, since there are limits on controlling crystal grain orientations and reducing impurities, a technique has been developed to introduce non-uniformity into a surface of a steel sheet by physical means to subdivide the width of a magnetic domain to reduce iron loss, i.e. a magnetic domain refining technique.

For example, JP S57-2252 B2 (PTL 1) proposes a technique of irradiating a steel sheet as a finished product with a laser to introduce high-dislocation density regions into a surface layer of the steel sheet, thereby narrowing magnetic domain widths and reducing iron loss of the steel sheet. Furthermore, JP H6-072266 B2 (PTL 2) proposes a technique for controlling the magnetic domain width by means of electron beam irradiation.

CITATION LIST

Patent Literature

PTL 1: JP S57-2252 B2
PTL 2: JP H6-072266 B2

SUMMARY OF INVENTION

Technical Problem

In recent years, there has been strong demand for a reduction in the noise generated when stacking steel sheets as the iron core of a transformer. In particular, there has been demand for suppression of transformer noise when providing the iron core of a transformer with a grain-oriented electrical steel sheet for which low iron loss properties have been achieved by the above magnetic domain refining.

An object of the present invention is therefore to propose a measure allowing for a reduction in noise generated by the iron core of a transformer or the like when grain-oriented electrical steel sheets, having reduced iron loss due to magnetic domain refining treatment, are stacked for use in the iron core.

Solution to Problem

Transformer noise is mainly caused by magnetostrictive behavior occurring when an electrical steel sheet is magnetized. For example, an electrical steel sheet containing approximately 3 mass % of Si generally expands in the magnetization direction.

When linear strain is applied with a continuous laser, electron beam, or the like either in a direction orthogonal to the rolling direction of the steel sheet or at a fixed angle to the direction orthogonal to the rolling direction, a closure domain is generated in the strain portion. In an ideal case, with no closure domain whatsoever in the steel sheet, and the magnetic domain structure of the steel sheet consisting only of the 180° magnetic domain facing the rolling direction, the change in the magnetic domain structure upon magnetization of the steel sheet only involves domain wall displacement of the 180° magnetic domain, which is already fully extended in the rolling direction due to magnetic strain. Therefore, the steel sheet does not expand or contract due to a change in the magnetic strain. When a closure domain exists in the steel sheet, however, the change in the magnetic domain structure upon magnetization of the steel sheet includes generation and elimination of the closure domain, in addition to domain wall displacement of the 180° magnetic domain. Since the closure domain expands in the widthwise direction of the steel sheet, the steel sheet exhibits expansion and contraction as a result of generation and elimination of the closure domain, due to change of the magnetic strain in the rolling direction and in the widthwise and thickness directions of the steel sheet. Accordingly, it is thought that if the amount of the closure domain in the steel sheet varies, the magnetic strain occurring due to magnetization and the noise upon stacking as the iron core of the transformer will also change.

The inventors of the present invention therefore focused on the volume fraction of the closure domain included in the steel sheet and examined the effect on iron loss and on transformer noise.

First, the inventors examined the relationship between magnetic flux density $B_8$ of the steel sheet and noise. In other words, if magnetization within the 180° magnetic domain deviates from the rolling direction, magnetization rotation occurs near the saturation magnetization upon magnetization of the electrical steel sheet. Such rotation increases the expansion and contraction in the rolling direction and the widthwise direction of the steel sheet and leads to an increase in magnetic strain. Therefore, such rotation is not advantageous from the perspective of noise in the iron core of the transformer. For this reason, highly-oriented steel sheets stacked with the [001] orientation of the crystal grains in the rolling direction are useful, and the inventors discovered that when $B_8 \geq 1.930$ T, the increase in noise in the iron core of the transformer due to magnetization rotation can be suppressed.

Next, the volume fraction of the closure domain is described. As described above, the generation of a closure domain is a factor in the magnetic strain occurring the rolling direction of a steel sheet. When this closure domain exists, the magnetization in the closure domain is oriented orthogonal to the magnetization of the 180° magnetic domain, causing the steel sheet to contract. When the closure domain in terms of volume fraction is E, then with respect to a state with no closure domain, the change in magnetic strain in the rolling direction is proportional to $\lambda_{100}\xi$. Here, $\lambda_{100}$ represents the magnetic strain constant $23\times10^{-6}$ in the [100] orientation.

In an ideal electrical steel sheet, the [001] orientation of all of the crystal grains is parallel to the rolling direction, and the magnetization of the 180° magnetic domain is also parallel to the rolling direction. In reality, however, the orientation of the crystal grains deviates at an angle from the rolling direction. Therefore, due to the magnetization in the rolling direction, magnetization rotation of the 180° magnetic domain occurs, generating magnetic strain in the rolling direction. At this time, with respect to when the magnetization of the 180° magnetic domain is parallel to the rolling direction, the change in magnetic strain in the rolling direction due to magnetization rotation is proportional to $\lambda_{100}(1-\cos^2\theta)$. Upon exciting the steel sheet and measuring the magnetic strain in the rolling direction, a mix of the two factors above is observed. Here, when $B_8 \geq 1.930$ T, the deviation of the [001] orientation of the crystal grains is 4° or less with respect to the rolling direction, yet the contribution of magnetization rotation to magnetic strain is $(6\times 10^{-4})\ \lambda_{100}$ or less, which is extremely small as compared to the magnetic strain of an electrical steel sheet that includes 3% Si. Accordingly, in a steel sheet with an excellent noise property, for which $B_8 \geq 1.930$ T, the magnetization rotation can be ignored as a factor in magnetic strain, and only the change in the volume fraction of the closure domain can fairly be considered to dominate. Therefore, by measuring the magnetic strain in the rolling direction, the volume fraction of the closure domain can be assessed.

In order to determine the volume fraction of the closure domain, it is necessary to compare a state when no closure domain at all exists and a state when the maximum amount of closure domain occurs in the steel sheet. With conventional magnetic strain assessment, however, measurement is performed without causing magnetic saturation in the steel sheet. In this state, a closure domain remains in the steel sheet, so that the volume fraction of the closure domain cannot be assessed accurately. The inventors therefore assessed the volume fraction of the closure domain based on magnetic strain measurement under saturated magnetic flux density. Under saturated magnetic flux density, the magnetic domain of the steel sheet is entirely the 180° magnetic domain, and as the magnetic flux density approaches zero due to an alternating magnetic field, a closure domain is generated, and magnetic strain occurs. Using the difference $\lambda_{P\text{-}P}$ between the maximum and minimum of the magnetic strain at this time, the volume fraction $\xi$ of the closure domain was calculated using equation (A) below.

$$\xi = -\frac{2}{3}\frac{\lambda_{p-p}}{\lambda_{100}} \tag{A}$$

The volume fraction of the closure domain in the steel sheet was also calculated, the $W_{17/50}$ value was measured with a single sheet tester (SST), and the noise of the iron core in the transformer was measured. FIG. 1 lists the measurement results in order. The volume fraction of the closure domain was calculated using the above method, and the measurement of magnetic strain in the rolling direction was performed using a laser Doppler vibrometer at a frequency of 50 Hz and under saturated magnetic flux density. The $W_{17/50}$ value is the iron loss at a frequency of 50 Hz and a maximum magnetic flux density of 1.7 T. Furthermore, the excitation conditions for the iron core of the transformer were a frequency of 50 Hz and a maximum magnetic flux density of 1.7 T. The sample was a grain-oriented electrical steel sheet having a sheet thickness of 0.23 mm and satisfying $B_8 \geq 1.930$ T. The method for applying strain was to irradiate the surface of the steel sheet with a continuous laser beam, setting the laser beam power to 100 W and the scanning rate to 10 m/s, and adopting a variety of conditions by changing the beam diameter on the surface of the steel sheet.

As the method of changing the beam diameter, the inventors changed the diameter of the laser beam striking the condenser lens for focusing the laser on the point to be irradiated with the laser beam and on the surrounding region of the surface of the steel sheet. In this way, the inventors discovered that with an increasingly larger beam diameter, the volume fraction of the closure domain applied to the sample continues to lower, and the accompanying noise of the iron core also continues to decrease.

On the other hand, the inventors discovered that as the beam diameter neared the minimum possible beam diameter for the laser irradiation device, the $W_{17/50}$ value reached a minimum, whereas upon expanding the beam diameter, the $W_{17/50}$ value tended to worsen. In particular, when the volume fraction of the closure domain became less than 1.00% due to expansion of the beam diameter, the $W_{17/50}$ so value became worse than 0.720 W/kg, and a good magnetic property could no longer be attained. Since the decrease in the volume fraction of the closure domain due to beam diameter expansion means a decrease in strain applied to the steel sheet, it is thought that such worsening of the magnetic property is due to an attenuated magnetic domain refining effect.

Based on the above results, the inventors managed to provide a grain-oriented electrical steel sheet that is suitable as an iron core of a transformer or the like and has an excellent noise property and magnetic property by adopting an excellent $B_8$ value and setting the amount of applied strain to be in a range of 1.00% or more to 3.00% or less in terms of the volume fraction of the closure domain occurring in the strain portion.

Specifically, primary features of the present invention are as follows.

(1) A grain-oriented electrical steel sheet with an excellent noise property, comprising linear strain in a rolling direction of the steel sheet periodically, the linear strain extending in a direction that forms an angle of 30° or less with a direction orthogonal to the rolling direction of the steel sheet, iron loss $W_{17/50}$ being 0.720 W/kg or less, a magnetic flux density $B_8$ being 1.930 T or more, and a volume occupied by a closure domain occurring in the strain portion being 1.00% or more and 3.00% or less of a total magnetic domain volume in the steel sheet.

(2) The grain-oriented electrical steel sheet according to (1), wherein the linear strain is applied by continuous laser beam irradiation.

(3) The grain-oriented electrical steel sheet according to (1), wherein the linear strain is applied by irradiation with an electron beam.

Advantageous Effect of Invention

According to the present invention, it is possible to achieve lower noise in a transformer in which are stacked grain-oriented electrical steel sheets that have reduced iron loss due to application of strain.

BRIEF DESCRIPTION OF DRAWINGS

The present invention will be further described below with reference to the accompanying drawings, wherein:

FIG. 1 illustrates a preferable range for the volume fraction of the closure domain in the present invention.

DESCRIPTION OF EMBODIMENTS

First, regarding transformer noise, i.e. magnetostrictive vibration of the steel sheet, the oscillation amplitude becomes smaller as the density of crystal grains of the material along the easy axis of magnetization is higher.

Therefore, to suppress noise, a magnetic flux density $B_8$ of 1.930 T or higher is necessary. If the magnetic flux density $B_8$ is less than 1.930 T, rotational motion of magnetic domains becomes necessary to align magnetization in parallel with the excitation magnetic field during the magnetization process, yet such magnetization rotation yields a large change in the magnetic strain, causing the transformer noise to increase.

In addition, changing the orientation, interval, or region of the applied strain changes the resulting iron loss reduction effect. When appropriate strain is not applied, the iron loss properties might not be sufficiently reduced, resulting in a good magnetic property not being attained, and even if the volume fraction of the closure domain is controlled, the magnetic strain might not decrease, preventing suppression of transformer noise. Therefore, by using a steel sheet to which strain has been appropriately applied and for which the iron loss $W_{17/50}$ is 0.720 W/kg or less, a noise reduction effect via control of the closure domain can be obtained.

Next, as the method for applying strain, continuous laser beam irradiation, electron beam irradiation, or the like is suitable. The irradiation direction is a direction intersecting the rolling direction, preferably a direction within 60° to 90° with respect to the rolling direction (a direction that forms an angle of 30° or less with the direction orthogonal to the rolling direction). Irradiation is performed at intervals of approximately 3 mm to 15 mm in the rolling direction. The amount of applied strain can be assessed by measuring the magnetic strain in the rolling direction under an alternating magnetic field that provides saturated magnetic flux density and then calculating the volume fraction of the closure domain with equation (A) above. Measurement of the magnetic strain is preferably performed with a method to prepare a single electrical steel sheet and use a laser Doppler vibrometer or a strain gauge.

Here, preferable irradiation conditions when using a continuous laser beam are a beam diameter of 0.1 mm to 1 mm and a power density, which depends on the scanning rate, in a range of 100 W/mm$^2$ to 10,000 W/mm$^2$. With respect to the condenser diameter of the laser beam, directly irradiating the surface of the steel sheet with a narrow beam, such that the minimum diameter determined by the configuration of the laser irradiation device is 0.1 mm or less, increases the amount of applied strain. The volume fraction of the closure domain also increases, causing the noise in the iron core of the transformer to increase. Accordingly, the volume fraction of the closure domain is adjusted by changing the diameter of the laser beam striking the condenser lens for focusing the laser. For example, irradiation is preferably performed under the condition that the beam diameter on the surface of the steel sheet is increased to approximately twice the minimum diameter. If the condenser diameter becomes too large, the magnetic domain refining effect lessens, suppressing the improvements in iron loss properties. Therefore, expansion of the condenser diameter is preferably limited to a factor of approximately five. Effective excitation sources include a fiber laser excited by a semiconductor laser.

On the other hand, preferable irradiation conditions when using an electron beam are an acceleration voltage of 10 kV to 200 kV and a beam current of 0.005 mA to 10 mA. By adjusting the beam current, the volume fraction of the closure domain can be adjusted. While the acceleration voltage is also a factor, if the current exceeds this range, the amount of applied strain increases, causing the noise in the iron core of the transformer to increase.

Note that as long as the grain-oriented electrical steel sheet has iron loss $W_{17/50}$ of 0.720 W/kg or less and a magnetic flux density $B_8$ of 1.930 T or more, the chemical composition is not particularly limited. However, an example of a preferable chemical composition includes, by mass %, C: 0.002% to 0.10%, Si: 1.0% to 7.0%, and Mn: 0.01% to 0.8%, and further includes at least one element selected from Al: 0.005% to 0.050%, N: 0.003% to 0.020%, Se: 0.003% to 0.030%, and S: 0.002% to 0.03%.

Example 1

A steel slab including, by mass %. C: 0.07%, Si: 3.4%, Mn: 0.12%, Al: 0.025%, Se: 0.025%, and N: 0.015%, and the balance as Fe and incidental impurities was prepared by continuous casting. The slab was heated to 1400° C. and then hot-rolled to obtain a hot-rolled steel sheet. The hot-rolled steel sheet was subjected to hot-band annealing, and subsequently two cold-rolling operations were performed with intermediate annealing therebetween to obtain a cold-rolled sheet for a grain-oriented electrical steel sheet having a final sheet thickness of 0.23 mm. The cold-rolled sheet for grain-oriented electrical steel sheets was then decarburized, and after primary recrystallization annealing, an annealing separator containing MgO as the primary component was applied, and final annealing including a secondary recrystallization process and a purification process was performed to yield a grain-oriented electrical steel sheet with a forsterite film. An insulating coating containing 60% colloidal silica and aluminum phosphate was then applied to the grain-oriented electrical steel sheet, which was baked at 800° C. Next, magnetic domain refining treatment was performed to irradiate with a continuous fiber laser in a direction orthogonal to the rolling direction. For the laser irradiation, the average laser power was set to 100 W and the beam scanning rate to 10 m/s, and a variety of conditions were adopted by changing the beam diameter on the surface of the steel sheet. $W_{17/50}$ measurement with an SST measuring instrument was performed on the resulting samples, which were sheared into rectangles 100 mm wide by 280 mm long. Using a laser Doppler vibrometer, the magnetic strain in the rolling direction was measured, and the volume fraction of the closure domain in each steel sheet was calculated in accordance with equation (A) above. As bevel-edged material with a width of 100 mm, the samples were stacked to a thickness of 15 mm to produce the iron core of a three-phase transformer. A capacitor microphone was used to measure the noise at a maximum magnetic flux density of 1.7 T and a frequency of 50 Hz. At this time, A-scale weighting was performed as frequency weighting.

Table 1 lists the measured noise of the iron core of the transformer along with the conditions on the focus of the laser beam and the beam diameter on the surface of the steel sheet, as well as the $B_8$ value of the steel sheet and the results of calculating the volume fraction of the closure domain. As is clear from Table 1, a steel sheet with $B_8 \geq 1.930$ T and with the volume fraction of the closure domain within the designated range yielded good characteristics, with the noise from the iron core of the transformer being lower than 36 dBA and the $W_{17/50}$ value also being equal to or lower than 0.720 W/kg.

By contrast, in a region where the beam diameter was too narrow, the volume fraction of the closure domain deviated from the range of the present invention, and the noise also worsened. Furthermore, when the beam diameter was too wide, the volume fraction of the closure domain was within the range of the present invention and the noise property was also good, yet the $W_{17/50}$ value was high. Even when the volume fraction of the closure domain was within the range of the present invention and the iron loss properties were good, a steel sheet with a $B_8$ value lower than 1.930 T had worse noise from the iron core of the transformer. Based on these results, it is essential for all three of the following to fall within the range of the present invention in order to achieve a grain-oriented electrical steel sheet suitable as the iron core of a transformer or the like: the magnetic flux density $B_8$, the iron loss $W_{17/50}$, and the volume fraction of the closure domain.

TABLE 1

| Steel sheet No. | Beam diameter on surface of steel sheet (mm) | Volume fraction of closure domain (%) | $B_s$ (T) | Iron loss $W_{17/50}$ (W/kg) | Noise (dBA) | Notes |
|---|---|---|---|---|---|---|
| 1 | 0.08 | 4.47 | 1.931 | 0.711 | 40.2 | Comparative example |
| 2 | 0.11 | 4.11 | 1.934 | 0.713 | 39.3 | Comparative example |
| 3 | 0.17 | 3.42 | 1.932 | 0.714 | 37.0 | Comparative example |
| 4 | 0.19 | 3.00 | 1.935 | 0.715 | 35.9 | Inventive example |
| 5 | 0.21 | 2.93 | 1.924 | 0.716 | 37.2 | Comparative example |
| 6 | 0.21 | 2.81 | 1.930 | 0.717 | 35.4 | Inventive example |
| 7 | 0.24 | 2.48 | 1.921 | 0.717 | 36.6 | Comparative example |
| 8 | 0.24 | 2.48 | 1.935 | 0.719 | 35.0 | Inventive example |
| 9 | 0.28 | 1.58 | 1.933 | 0.720 | 34.7 | Inventive example |
| 10 | 0.30 | 1.00 | 1.934 | 0.720 | 34.5 | Inventive example |
| 11 | 0.40 | 0.79 | 1.936 | 0.726 | 34.1 | Comparative example |

Example 2

The same samples as the electrical steel sheets that, before laser irradiation, were used for laser beam irradiation in Example 1 were irradiated with an electron beam, adopting a variety of conditions by changing the beam current under the conditions of an acceleration voltage of 60 kV and a beam scanning rate of 30 m/s. Like Example 1, the volume fraction of the closure domain in the steel sheet, the $W_{17/50}$ value, and the noise from the iron core of the transformer were measured for the resulting samples.

Table 2 lists the measured noise from the iron core of the transformer, along with the beam current, the $B_8$ value, and the volume fraction of the closure domain. For the electron beam as well, reduced noise was achieved, with noise of 36 dBA or less, in samples for which $B_8 \geq 1.930$ T and the beam current was lowered so that the volume fraction of the closure domain was within the designated range.

By contrast, when the current density was raised, the volume fraction of the closure domain exceeded the range of the present invention, resulting in increased noise, whereas when the current density was lowered, the volume fraction of the closure domain fell below the range of the present invention, and the $W_{17/50}$ value worsened. Furthermore, even when the volume fraction of the closure domain was within the range of the present invention, and the $W_{17/50}$ value was 0.720 W/kg or less, the samples had noise greater than 36 dBA when $B_8 < 1.930$ T. Hence, for electron beam irradiation as well, the magnetic property can be made compatible with the noise property only by all three of the following falling within the range of the present invention: the magnetic flux density $B_8$, the iron loss $W_{17/50}$, and the volume fraction of the closure domain.

TABLE 2

| Steel sheet No. | Beam current (mA) | Volume fraction of closure domain (%) | $B_s$ (T) | Iron loss $W_{17/50}$ (W/kg) | Noise (dBA) | Notes |
|---|---|---|---|---|---|---|
| 1 | 10 | 4.70 | 1.932 | 0.704 | 41.4 | Comparative example |
| 2 | 9 | 3.76 | 1.930 | 0.707 | 41.1 | Comparative example |
| 3 | 8 | 3.45 | 1.934 | 0.711 | 38.6 | Comparative example |
| 4 | 7.5 | 3.00 | 1.936 | 0.712 | 35.8 | Inventive example |
| 5 | 7 | 2.88 | 1.920 | 0.720 | 36.7 | Comparative example |
| 6 | 7 | 2.46 | 1.930 | 0.714 | 35.5 | Inventive example |
| 7 | 6 | 2.12 | 1.935 | 0.717 | 35.2 | Inventive example |
| 8 | 4 | 1.24 | 1.933 | 0.719 | 35.0 | Inventive example |
| 9 | 3.5 | 1.00 | 1.934 | 0.720 | 34.7 | Inventive example |
| 10 | 3 | 0.86 | 1.931 | 0.731 | 34.5 | Comparative example |

The invention claimed is:

1. A grain-oriented electrical steel sheet, comprising:

periodic linear strain in a rolling direction of the steel sheet, the linear strain extending in a direction that forms an angle of 30° or less with a direction orthogonal to the rolling direction of the steel sheet, iron loss $W_{17/50}$ being 0.720 W/kg or less, a magnetic flux density $B_8$ being 1.930 T or more, and a volume fraction $\xi$ of a closure domain occurring in the strain portion being 1.00% or more and 3.00% or less of a total magnetic domain volume in the steel sheet, wherein the volume fraction $\xi$ is defined by following formula (A) using a magnetic strain constant $\lambda_{100}$ in [100] orientation, $23\times10^{-6}$, and a difference $\lambda_{P\text{-}P}$ between the maximum and minimum of the magnetic strain measurement with an alternating magnetic field under saturated flux density $$\xi = -\frac{2}{3}\frac{\lambda_{p-p}}{\lambda_{100}}. \quad \text{(A)}$$

2. The grain-oriented electrical steel sheet according to claim 1, wherein the linear strain is applied by continuous laser beam irradiation.

3. The grain-oriented electrical steel sheet according to claim 1, wherein the linear strain is applied by irradiation with an electron beam.

4. The grain-oriented electrical steel sheet according to claim 1, wherein a deviation of the [001] orientation is 4° or less.

5. The grain-oriented electrical steel sheet according to claim 1, wherein a contribution of magnetization rotation to magnetic strain is $(6\times10^{-4})\lambda_{100}$ or less.

6. The grain-oriented electrical steel sheet according to claim 1, wherein the steel comprises by mass %, C: 0.002% to 0.10%, Si: 1.0% to 7.0%, and Mn: 0.01% to 0.8%.

7. The grain-oriented electrical steel sheet according to claim 6, wherein the steel further comprises at least one element selected from the group consisting of Al: 0.005% to 0.050%, N: 0.003% to 0.020%, Se: 0.003% to 0.030%, and S: 0.002% to 0.03%.

* * * * *